US005226660A

United States Patent [19]

Curchod

[11] Patent Number: 5,226,660

[45] Date of Patent: Jul. 13, 1993

[54] GOLF SIMULATOR APPARATUS

[76] Inventor: Donald B. Curchod, 345 Eleanor Dr., Woodside, Calif. 94062

[21] Appl. No.: 699,959

[22] Filed: May 14, 1991

Related U.S. Application Data

[63] Continuation-in-part of Ser. No. 448,155, Dec. 8, 1989, abandoned, which is a continuation-in-part of Ser. No. 357,059, May 25, 1989, abandoned.

[51] Int. Cl.[5] ..... A63B 69/36

[52] U.S. Cl. ..... 273/185 B; 273/181 E; 273/35 A; 273/176 R; 273/183.1; 273/186.1

[58] Field of Search ..... 273/32 R, 35 R, 35 A, 273/35 B, 176 R, 181 E, 181 J, 183 R, 183 A, 184 R, 185 R, 185 A, 185 B, 186 B, 183 C, 213

[56] References Cited

U.S. PATENT DOCUMENTS

| | | | |
|---|---|---|---|
| 2,783,999 | 3/1957 | Simjian | 273/181 B |
| 3,310,310 | 3/1967 | McKee | 273/184 R |
| 3,406,571 | 10/1968 | Hackey | 273/185 A |
| 3,540,735 | 11/1970 | Miller | 273/183 C |
| 3,563,553 | 2/1971 | Baldwin et al. | 273/185 B |
| 3,598,976 | 8/1971 | Russel et al. | 273/185 A |
| 3,620,537 | 11/1971 | Conklin et al. | 273/185 A |
| 3,630,601 | 12/1971 | Lebovee | 273/183 C |
| 3,759,528 | 9/1973 | Christophers et al. | 273/185 R |
| 3,837,655 | 9/1974 | Angelos | 273/185 R |
| 4,136,387 | 1/1979 | Sullivan et al. | 273/185 R |
| 4,150,825 | 4/1979 | Wilson | 273/185 B |
| 4,437,672 | 3/1984 | Armantrout et al. | 273/185 B |

FOREIGN PATENT DOCUMENTS

| | | | |
|---|---|---|---|
| 2618343 | 1/1989 | France | 273/176 R |
| 0146046 | 11/1980 | Japan | 273/184 R |
| 2154146 | 9/1985 | United Kingdom | 273/185 A |
| 2206496 | 1/1989 | United Kingdom | 273/35 B |

*Primary Examiner*—Jessica J. Harrison

*Attorney, Agent, or Firm*—Flehr, Hohbach, Test, Albritton & Herbert

[57] ABSTRACT

A golf simulating apparatus having a driving simulator and an actual green area adjacent thereto for simulating a complete game of golf, comprising apparatus for generating signals indicative of the velocity, trajectory and spin of a hit golf ball. A computer apparatus connected to the generating apparatus is provided for receipt of the signals and for processing the signals to determine the distance and location of the hit golf ball would have travelled on a golf course, the computer apparatus calculating the lie of the ball on a simulated hole. Also, display apparatus controlled by the computer apparatus is provided for projecting the simulated hole of golf so that as a golfer moves down the fairway the view of the hole from the golfers vantage point is displayed.

3 Claims, 9 Drawing Sheets

VELOCITY = K TIME BA + TIME B1A1/2
RATE OF SPIN IS PROPORTIONAL TO DIFFERENCE
BETWEEN AB AND A1B1

GOLF SIMULATOR APPARATUS

This is a Continuation-In-Part of co-pending application Ser. No. 07/448,155, now abandoned, filed Dec. 8, 1989 in the name of Donald B. Curchod and entitled GOLF SIMULATOR APPARATUS AND METHOD which is a Continuation-In-Part of co-pending application Ser. No. 07/357,059, now abandoned, filed May 25, 1989, in the name of Donald B. Curchod and entitled GOLD SIMULATOR APPARATUS AND METHOD, now abandoned.

BACKGROUND OF THE INVENTION

1. Field of the Invention

The present invention relates to golf simulation. More specifically, the present invention relates to realistically simulating the driving portion of a golf game in association with an actual golf green, thereby significantly reducing the geographical area required to play a game of golf.

2. Prior Art

A standard game of golf is played on an 18-hole course. The game is comprised of driving and putting strokes. The player drives his or her ball to the green area and then putts the ball into the hole.

As is well known, the driving portion of the game requires the greatest geographical area. Often it takes two to four strokes to put a ball in the green area. Each of these strokes are powerful drives hitting the golf ball a significant distance down the fairway. The putting portion, on the other hand, requires precision. The ball must be skillfully hit, often with a rather soft touch. Therefore, putting requires the smallest geographical area of a golf course.

With the growth of our cities, real estate for golf courses close to urban centers has been hard to find. Also, with the rise in real estate prices, golf courses may be hard to justify. Therefore, attempts have been made to reduce the size of the driving portion of the course.

One present method consists of an electronic pad with sensors. In this instance, the ball is placed on a tee and four or more sensors are placed in a rectangle underneath and behind the ball. The rectangular sensor configuration basically forms two parallel pairs of sensors. As a golf club is swung at a ball and contacts it, the club passes over the first parallel pair of sensors and then the second pair. The time interval between the two pairs of sensors determines the speed of the club head at impact. This is used to determine the speed of the ball.

A pair of sensors is used so that the angle of the club head with respect to the ball can be determined. The front edge of the club forms approximately a straight line. If a club is swung square on with the ball, the near side of the club face will pass over one of the second parallel pair and the far side of the club face will pass over the other sensor of the second parallel pair at the same time. If there is any deviation from being straight on, one portion of the club face will pass over one sensor before the other portion passes over its sensor. This angle of deviation denotes the angle of the club head. The angle is used to determine direction as well as hook or slice.

The player is required to enter into a controlling computer the type of club that is being used, i.e., 3 iron, 7 iron, etc. The type of club indicates the cut of the club face. From the above factors the controlling computer determines the hypothetical distance and direction of the shot.

There are several problems with this system with respect to realistic simulation. One is that it does not indicate spin, either horizontal or vertical. Both of these phenomena have a significant effect on the flight of the ball. Another is that although the type of club can be entered into the computer, a player may not hit the ball very well. In that instance the computer using speed and angle of the club measurements and the type of club would provide the same read out regardless of the quality of hit. Sit another problem is that the simulator, even though it may be connected to a computer and a CRT monitor fails to compensate for the natural outdoor setting of regular golf game. No interaction between a destination hole and the player is provided.

According to an improved embodiment of the invention as disclosed herein, it will be readily evident that if the simulator can project a number of different golf holes as desired by the golfer controlling the computer, and only a single real putting green can be employed in association with the unit, the computer must provide some equivalent ball positioning between the green displayed and the green to be putted upon.

SUMMARY OF THE INVENTION

Accordingly, it is the object of the present invention to provide a more realistic simulated golf game.

It is another object of the present invention to provide a simulated golf game which measures and takes into account the spin applied to a hit golf ball.

It is another object of the present invention to provide a golf simulator that more accurately measures trajectory and speed of a hit golf ball.

It is another object of the present invention to provide a simulated golf game that significantly reduces the geographic area required to play a game of golf.

It is another object of the present invention to provide a golf simulator that can be played day or night, regardless of weather conditions.

It is another object of the present invention to provide a golf simulator that saves time by eliminating the wait involved with sequentially following others through a golf course.

An aspect of the disclosed system includes means for detecting where a player's ball should be placed on or near the putting green surface and adjacent apron areas.

It is another aspect of the present invention to provide a simulated golf game having a video projection of the hole being played and incorporating each shot in the projection as the player progresses down the fairway.

It is another object of the present invention to provide a realistic golf game with electronic hole display and determination of ball trajectory coupled to and integrated with an adjacent putting or green area.

The attainment of these and related objects may be achieved through use of the novel golf simulator apparatus and method herein disclosed. A golf simulator apparatus and method in accordance with this invention has a driving simulator and an actual green or putting area adjacent thereto for simulating a complete game of golf. The system and apparatus comprises means for generating signal indicative of the velocity, trajectory and spin of a hit golf ball. A computer apparatus connected to the generating apparatus is provided for receipt of the signals and for processing the signals to determine the distance and location that the hit golf ball would have travelled on a golf course the computer apparatus calculating the location of the lie on the ball relative to a simulated hole. Also, display apparatus controlled by the computer apparatus is provided for projecting the simulated hole of golf so that as a golfer moves down the fairway the view of the hole from the golfer's various vantage points is displayed.

The attainment of the foregoing and related objects, advantages and features of the invention should be more readily apparent to those skilled in the art, after review of the following more detailed description of the invention, taken together with the drawings.

BRIEF DESCRIPTION OF THE DRAWINGS

The accompanying drawings, which are incorporated in and form a part of this specification, illustrate embodiments of the invention and, together with the description, serve to explain the principles of the invention.

Figure 9:
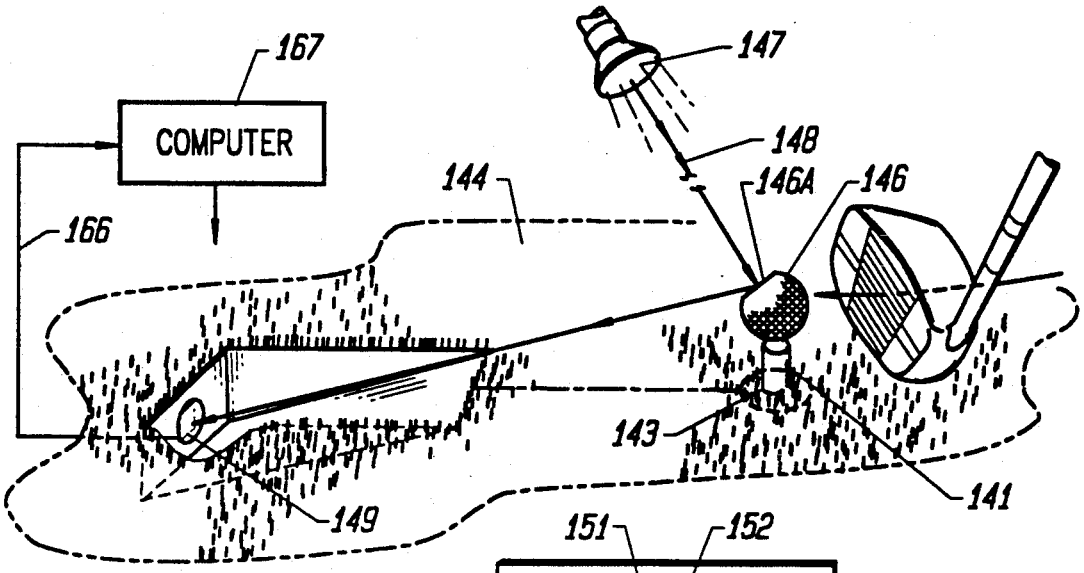
Figure 10:
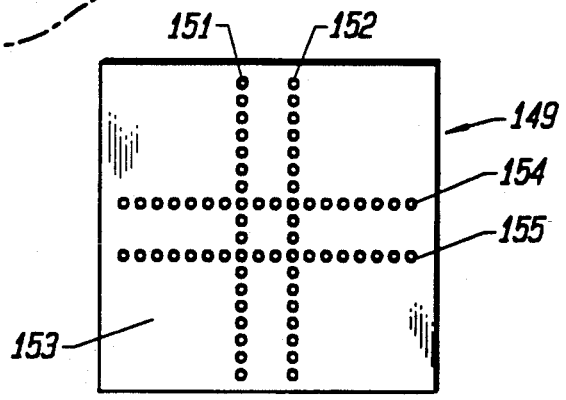
Figure 11:
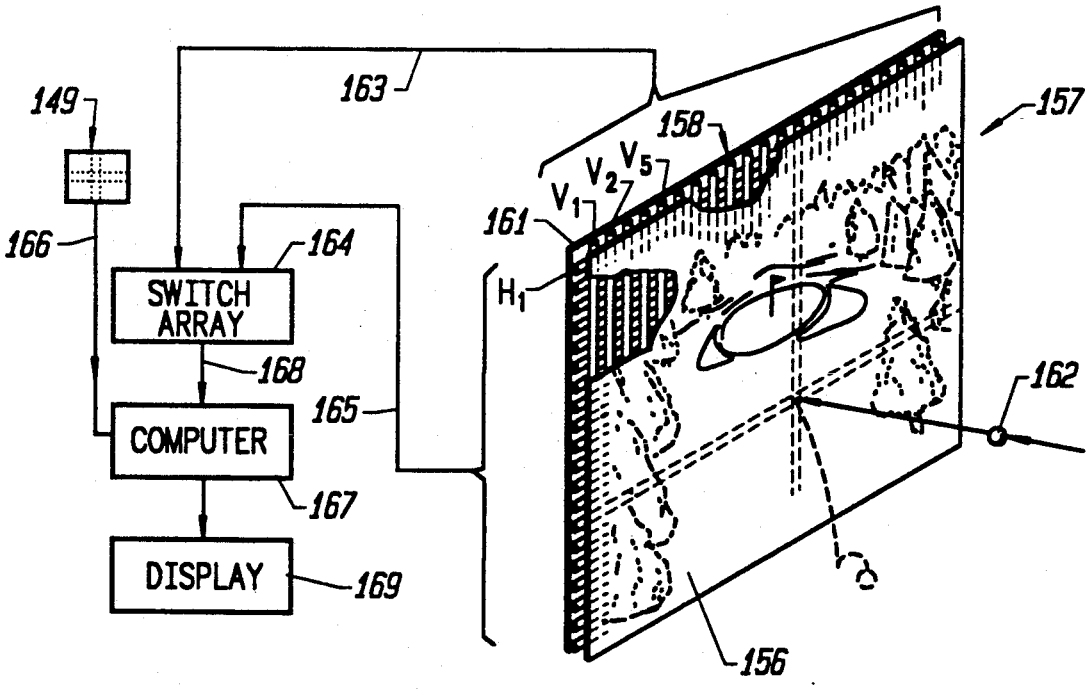

FIGS. *7a* and *7b* illustrate an application of the preferred embodiment;

FIGS. *8a* and *8b* illustrate an alternate preferred embodiment;

FIG. 9 shows a diagrammatic perspective view of the tee area of another embodiment according to the invention;

FIG. 10 shows an enlarged diagrammatic view of a spin detecting element used in the embodiment shown in FIG. 9;

FIG. 11 shows a diagrammatic view of a target screen for use with the embodiments disclosed herein.

Figures 12, 13:
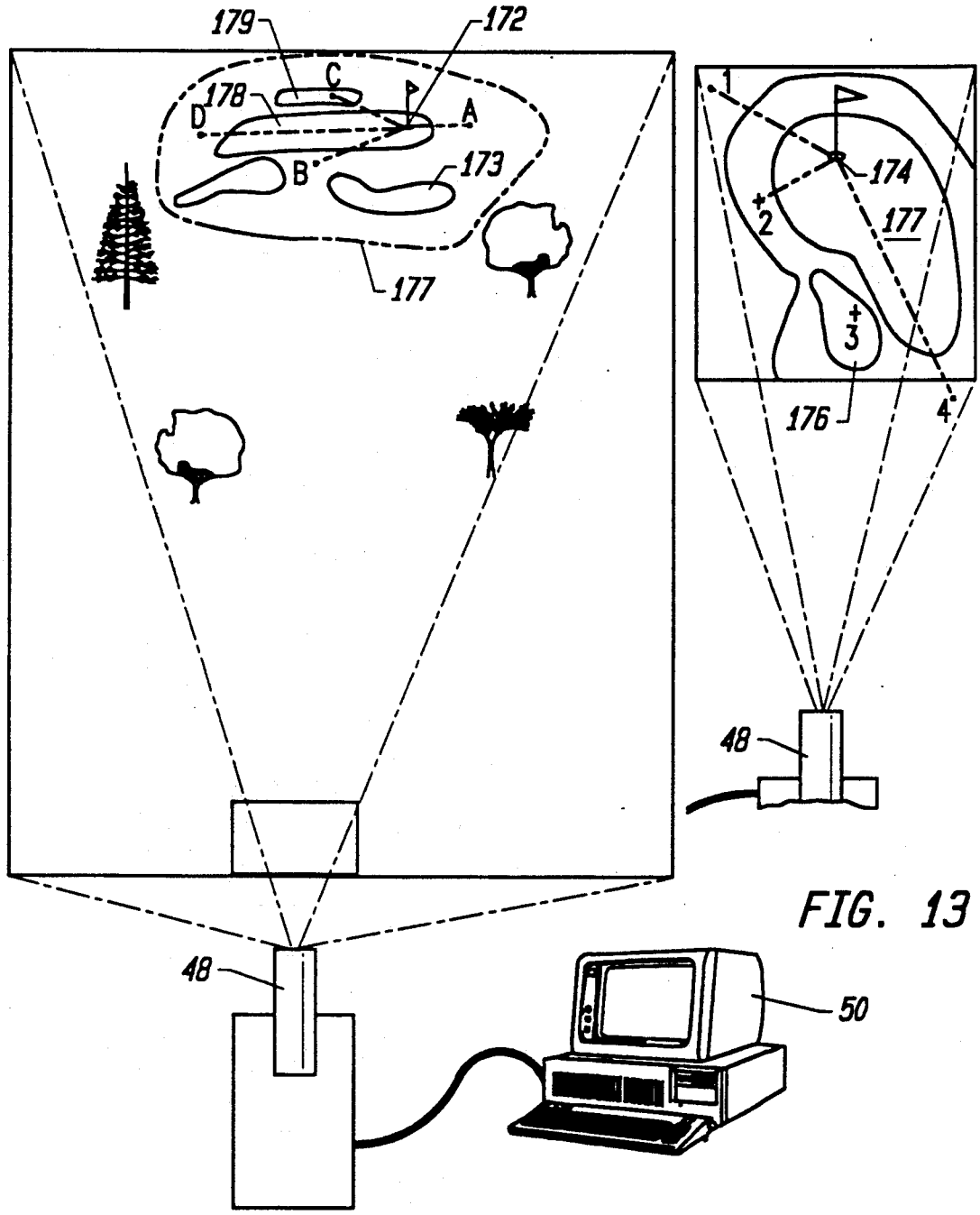

FIG. 12 shows an elevation view of a projected image of a selected green to be played to in the driving simulator.

FIG. 13 shows a plan view of a real putting green adjacent the driving simulator for purposes of explanation of another embodiment of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
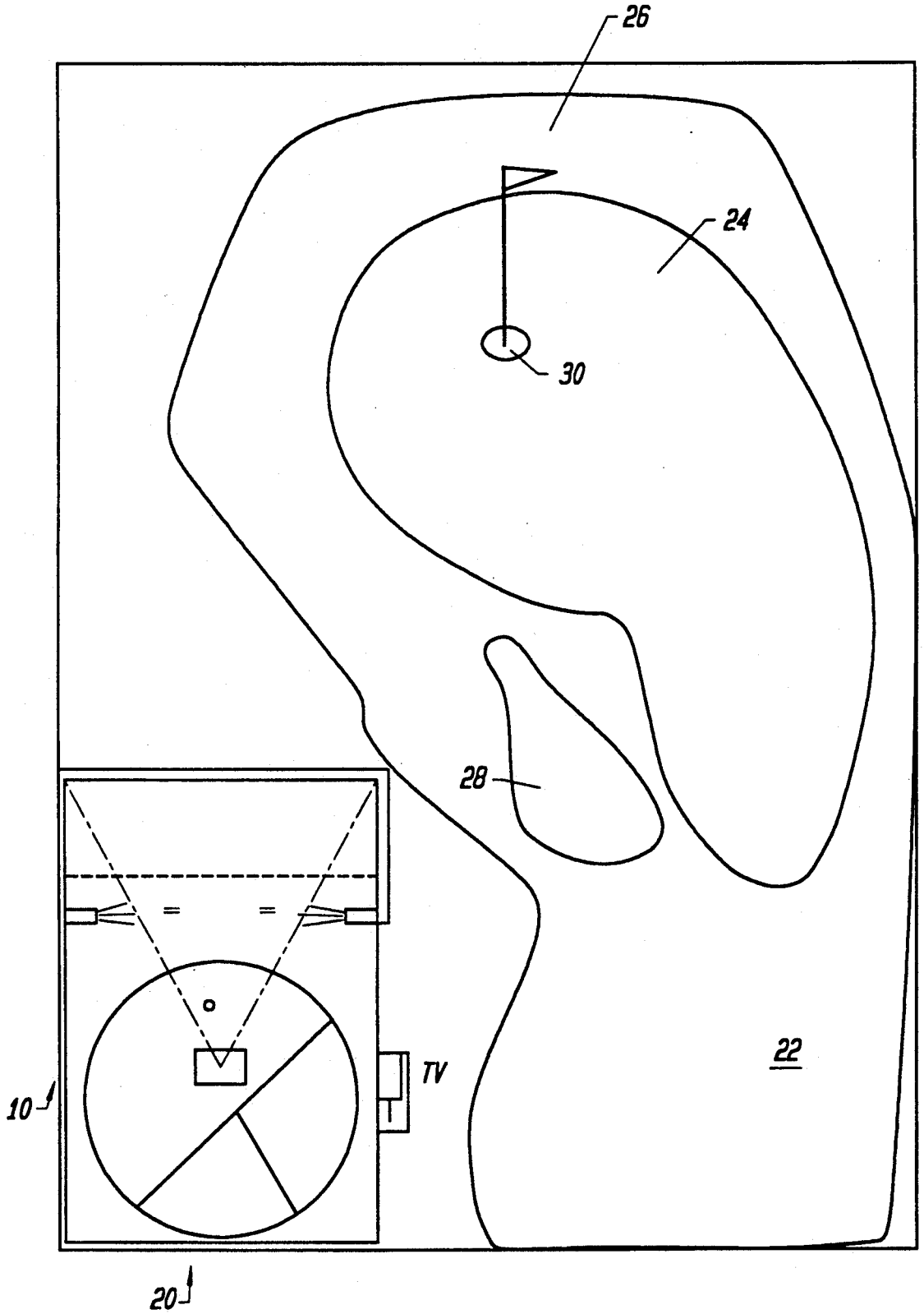
FIG. 1 is a plan view of the golf simulation device of the preferred embodiment.

Referring to FIG. 1, an overview of the present invention and the environment in which it is used is shown. The present invention provided a golf simulation apparatus which reduces the size in a geographic context of a golf course. This is accomplished by separating the driving and putting and/or putting green surroundings and components of a golf course. In the golf simulator 10 is a special driving simulator 20 which is set up to replicate the driving portion of the golf game, the part which takes up the largest geographical portion of a golf course. The "driving" portion of a given golf hole is considered to be that extent of fairway and adjacent rough which extends from the tee to a predetermined region close to the green wherein the system can direct the player to place his ball for chipping or putting into the hole. Adjacent the driving portion 20, is the putting and chipping portion (hereinafter "putting portion") 22. The putting portion is not a simulated replication of a golf course, it is a physically real putting green 24 surrounded by fairway 26 and a bunker 28. In the driving simulator 20, which is described in more detail below, a golfer tees off and drives down the fairway until he or she approaches the simulated green. Once the golfer is within a certain predefined distance of the simulated hole, the golfer walks out of the driving portion 20 and onto the green portion 22. The golf ball is placed on the green portion 22 at the location specified by the driver simulator 20. From this point, the golfer plays the ball to the hole 30. To provide a more realistic simulation the video projection of the hole and green area is a replica of the adjacent, associated actual hole and green area. Having espoused the general principle of operation for the present invention, focus is now drawn to the driving simulator 20. Further, while the green preferably is a real green of grass, artificial grass can be used.

Figure 2:
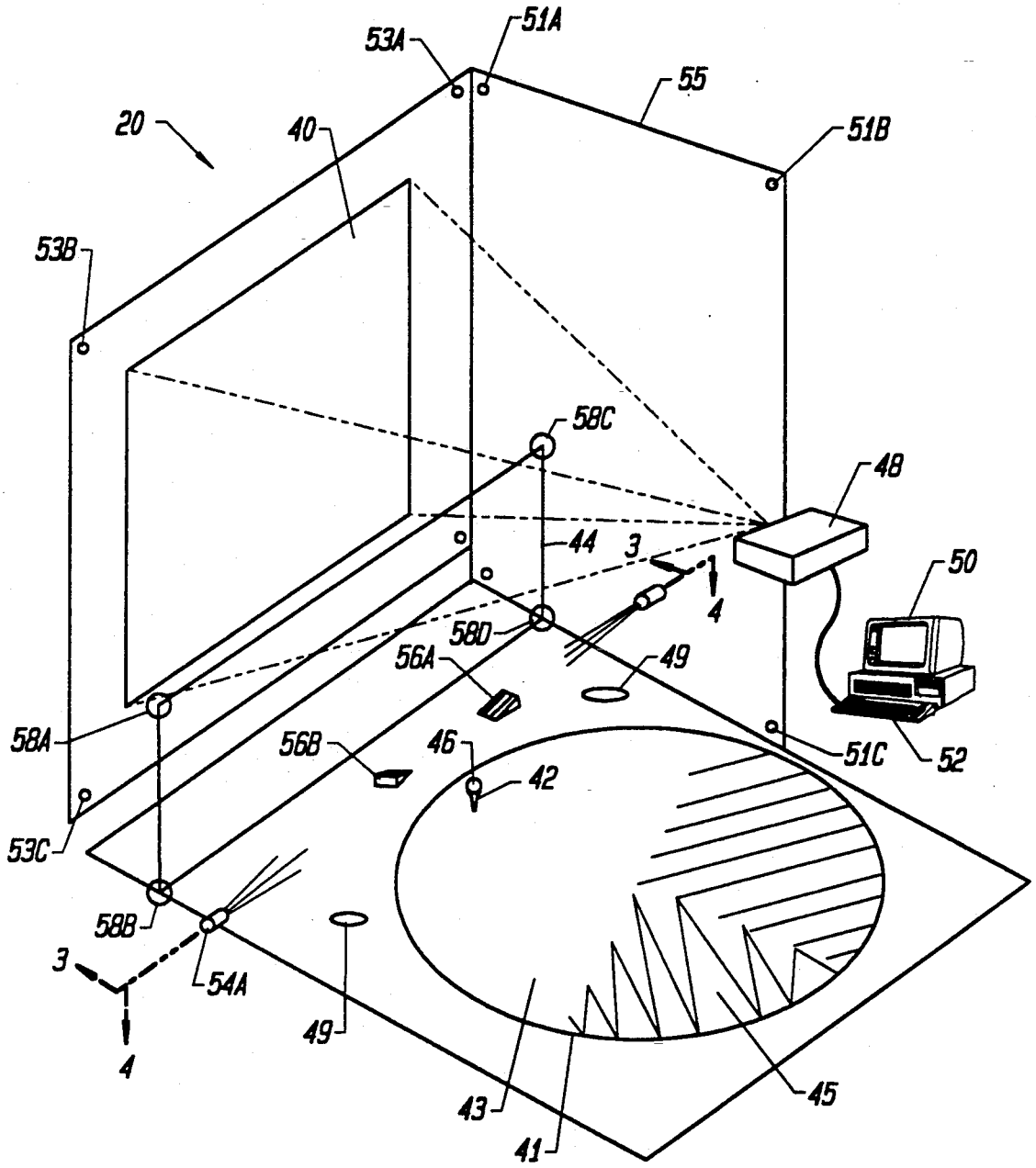
FIG. 2 is a perspective view of the driving simulator of the preferred embodiment.

Referring to FIG. 2, the driving simulator 20 consists of a plurality of components. The basic precept illustrated in FIG. 2 is that the golfer tees off for a green (and hole) projected on the screen 40 by a video projector 48. The projected green is indicative of putting area 22, facilitating realistic golfing experience. Video projection of an image (such as a golf hole) from a computer (50 of FIG. 2) is known in the art. The golfer then continues to drive the ball until it reaches a predefined distance from the projected hole. Starting at tee 42 the golfer drives a golf ball 46 toward the net 44. As the golf ball 46 travels from the tee 42 to the net 44, it passes through, or comes in contact with a plurality of sensors (which are described in more detail below). The screen 40 is raised above or at eye level with the net 44. That way, a golfer standing at tee 42 can see over the net 44 for a clear view of the screen 40.

A video projector 48 displays a video image of a hole of golf as a golfer would view the hole 30 while the golfer is driving toward it. The video projector is controlled by a computer 50. Computer 50 controls a plurality of functions, described below, and interacts with the golfer through keyboard 52. In a typical scenario, the golfer prompts the computer to indicate that a game of golf is desired. The golfer may play solo or play in groups. Once the computer is prompted it generates an image of the first hole as viewed from the tee area. A golfer steps to the tee 42 and hits a golf ball toward the screen as though the golfer was on a real golf course hitting off the tee towards the hole. A tee sensor 49 senses movement of the ball 46 off the tee 42. That way, shots that do not register on the other sensors (56 and 58) are accounted for.

The tee 42 is placed on a turntable 41. Turntable 41 is divided into a plurality of sections. They include a fairway portion 43, a bunker (or sand trap) portion 45 and a rough portion 47. A tee off portion may also be provided. As the player moves the ball down the course any of these situations may be encountered. The computer 50 indicates which one of these areas a player has hit into. The indication appears on a CRT monitor 51. The player then places the ball in the designated area and plays on. The turntable is easily rotatable and locks into place where desired.

The ball will first pass through a plane that is parallel to the plane of screen 40. This plane is defined by sensors 56A and 56B and is approximately perpendicular to the floor of driving simulator 20. Ball 46 then contacts the net 44. From the time it takes the ball to pass from the first plane, defined by sensors 56A and 56B, until it contacts the second plane, defined roughly by net 44, is used to calculate the velocity of the ball. Also the tee sensor 49 could be used to initiate the velocity measurement. The calculation of speed is simply a calculation of distance divided by time, the distance the ball travels once it passes through the first sensor plane to the second sensor plane divided by the amount of time required for the ball to travel that distance. Since the plane defined by the net 44 is in fact "planar" the distance the ball travels from the tee to the net will vary depending on which portion of the net the ball contacts. Note that for the distance from the tee 42 to the net 44 to be the same for each position on the net 44, the net 44 would have to be spherical. In order to compensate for this shortcoming and in order to accurately calculate ball trajectory, four sensors 58A–D are placed at the four corners of the net 44. The sensors 58A–D are pressure transducers. Their outputs are inputs to the computer 50.

Figure 3:
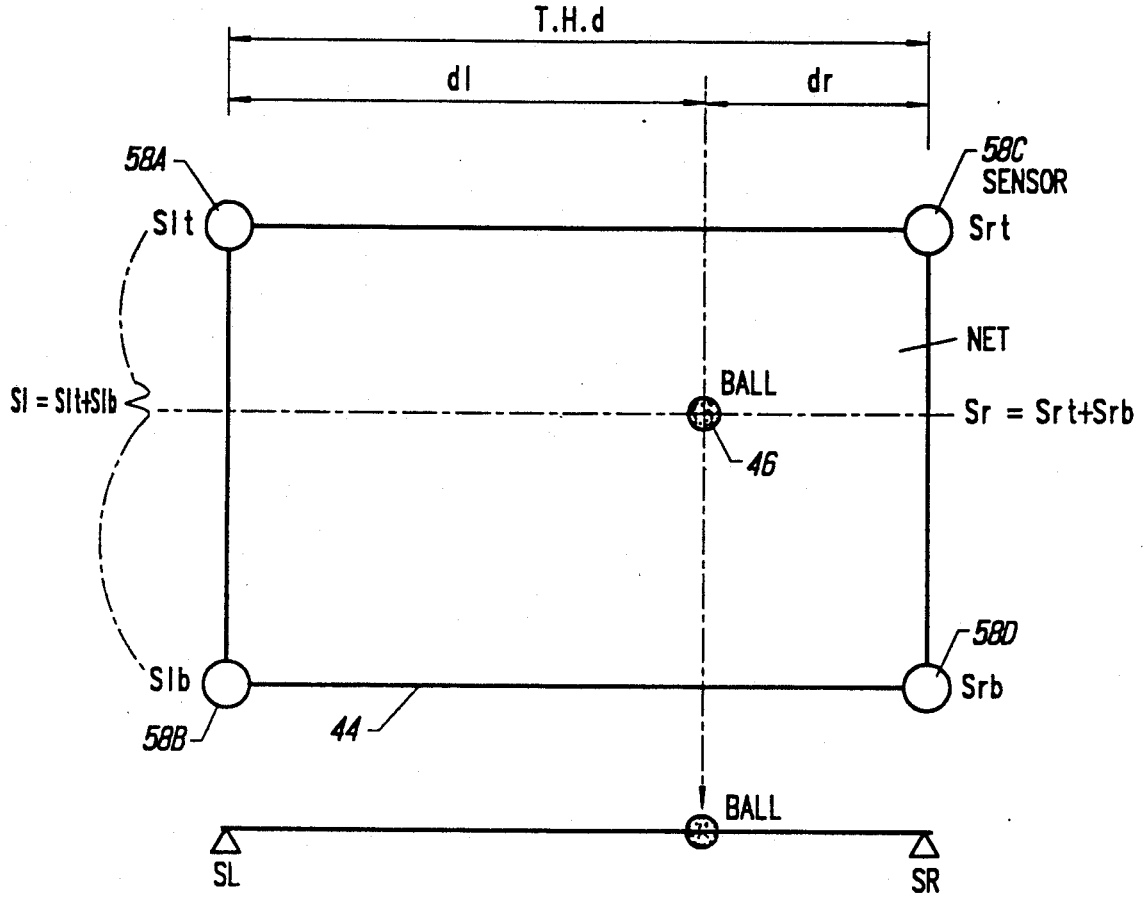
FIG. 3 is a diagram of the net sensors of the preferred embodiment.

Referring to FIG. 3, the location of the sensors 58A–D relative to the net and to an incoming ball are illustrated. The four sensors, 58A–D, produce analog voltage signals indicative of the amount of force applied by the ball 46 on the net 44. For example, if the ball 46 contacts the net 44 in its exact center the voltage signal produced by each sensor 58A–D will be the same. These analog signals are measured at their peak, converted to digital signals and sent to the computer 50. The calculation to determine location of net 44 contact involves several parameters. Focusing on the horizontal component, THD equals total horizontal distance. The distance of the ball from the left side is dl, from the right side dr. The total sensor readings on the left side is SL, on the right SR. When the ball stops moving, the sensor readings are at a maximum. It can be shown that for the horizontal faces:

$$SLdl = SRdr$$

Since the THD = dl + dr and dl = (SRdr/Sl):

$$\frac{SRdr}{SL} + dr = THD.$$

Solving for dr:

$$dr\ (SR/SL + 1) = THD, \text{ so}$$

$$dr = THD/(SR/SL + 1)$$

This gives the horizontal distance of the ball 46 from the left hand side of the net 44. The vertical position of the ball is determined in the same manner. Once vertical and horizontal measurement of ball are known, the distance from the tee 42 to that location on the net 44 is readily ascertained. Alternative mathematical operations could be used to measure ball 46 location on the net 44. These are well known and incorporated herein.

Once the distance from the tee 42 to the net 44 is determined, it is divided by travel time to give velocity.

In addition to being useful for measuring the velocity of the ball 46, the location at which the ball 46 contacts the net 42 also determines the trajectory of the ball 46. The trajectory and velocity of the ball are used to determine where the ball 46 would have landed had the golfer been on a regular golf course.

Note that the screen 40, wall 55 and a wall across the net 44 form wall 55 (not shown) are used to track misfits which miss the net 44 (the net is positioned to catch correctly hit balls from all standard clubs). Sensors 51 *a–d* (on wall 55) and 53 *a–d* (on screen 40) serve the same function as sensors 58 *a–d*. Sensors may also be positioned on the ceiling (not shown) so that all shots are accounted for.

Figure 4:
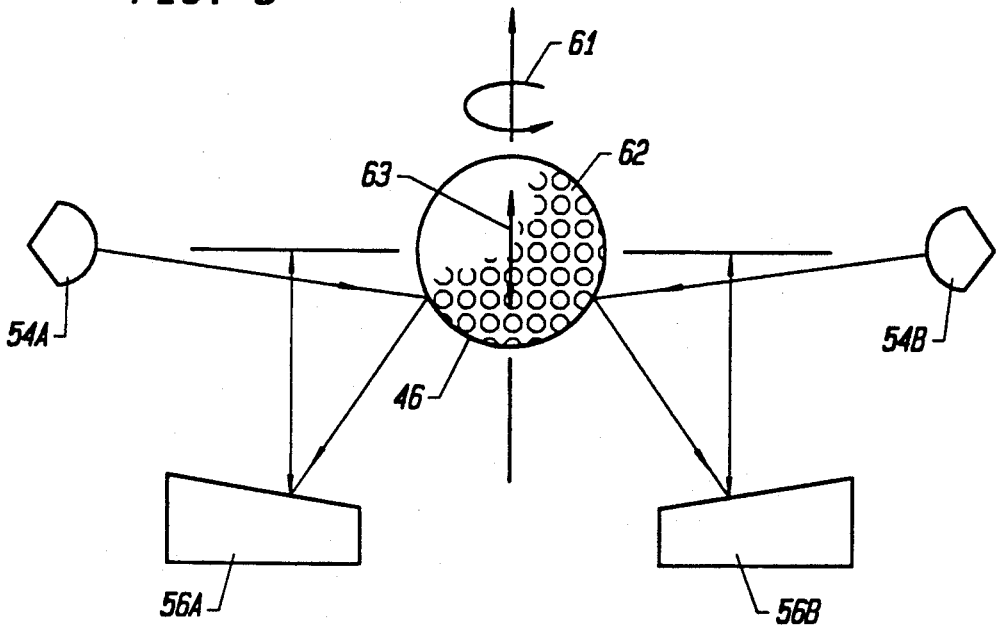
FIG. 4 is a front view of a sensor arrangement of the preferred embodiment.

Another crucial aspect in calculating where a hit golf ball 46 will land is determining the hook or slice in the golf ball 46. This measurement is made using a plurality of components. These components include light sources 54A and 54B and sensors 56A and 56B. Referring to FIG. 4, the relationship between the light sources 54, ball 46 and sensors 56 is illustrated. Light sources 54 emit a light beam which propagates within the plane defined by the light sources 54A and B and sensors 56A and B. For purposes of the present invention, a special golf ball 46 is used. The golf ball 46 is special because it has highly reflective facets 62. These facets 62 serve to reflect the light emitted by light sources 54A and B onto sensors 56A and B. FIG. 4 illustrates the reflection of the light beam off of the highly reflective facets 62 of the golf ball 46 and onto the sensor 56A.

Figure 5:
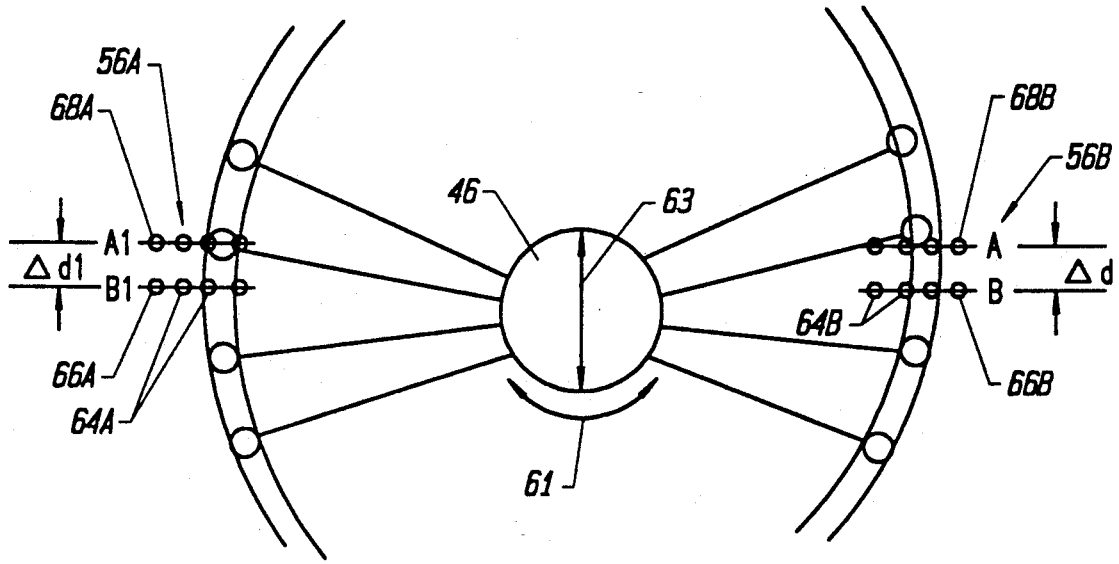
FIG. 5 is a top view of a sensor arrangement of the preferred embodiment.

Referring to FIG. 5, a top view of the golf ball 46 and the sensors 56A and 56B is shown. The sensors 56A and 56B are divided into two rows 66A and 66B and 68A and 68B. Each of these rows is comprised of a plurality of light sensing devices 64. The arrangement of these rows forms an important aspect of the present invention for rate of spin determination in a horizontal and vertical plane.

The horizontal spin component is represented by arrow 61. As the ball 46 passes into the plane of the light source 54A and 54B and the sensors 56A and 56B, light is reflected from the light source onto the sensors 56A and 56B. Focusing on sensor 56B, the reflecting light will strike row 68 (designated by letter A) and row 66 (designated by letter B) at different times. Whether the light impinges on row A before it impinges on row B gives the direction of the spin. An additional measurement is made equivalent to the time it takes the light to reach from row A to row B or visa versa. This measurement is used to determine rate of spin. Focusing now on sensor 56A the same procedure is followed. The spin on the ball 46 will cause the reflected beam of light to impinge upon either row 66A then row 68A (designated by letters Bl and Al, respectively), or vice-versa.

If the ball passes over the sensors 56A and 56B with no spin, it will first reflect light onto the first row of sensors (A and Al) and then on the second row (B and Bl). The time difference between rows of the sensors 56A and B will be identical, thereby indicating that there is no horizontal spin. Horizontal spin is indicated when there is a difference in the measurement between the two rows (A/Al and B/Bl) for the two sensors 56A and B. The rate of spin is proportional to the difference in time measurements for the light to travel distance d and dl, if ball 46 is centered between **56*a* and 56*b***.

If ball 46 is not centered over sensors 56*a* and 56*b*, this off center can be calculated from the position where ball 46 strikes net 44. In this case any error in horizontal spin rate from this lack of centering can be eliminated prior to calculation of trajectory.

The vertical spin component is illustrated by arrow 63. Vertical spin is measured by comparing two velocity measurements. The first velocity measurement is that discussed above, as measured between sensors 56A and B and the net 44 (hereinafter "TV" for total velocity). The second measurement is the velocity of light reflecting off the ball from a first sensor row 68A to a second row 68B. To compensate for the ball 46 being closer to one sensor 56, an average is taken of the velocity measurement for each sensor:

$$(V_{56A}+V_{56B})/2$$

where $V_{56A}$ is for the left sensor and $V_{56B}$ is for the right sensor.

Vertical spin velocity is obtained by subtracting these measurements from one another:

$$\text{i.e., Vertical spin}=((V_{56A}+V_{56B})/2-TV$$

If the result is zero in the horizontal plane there is no vertical spin. If it is not, the direction and magnitude of the spin is known.

The sensors 56A and B produce digital signals indicative of the time required for a reflected light beam to pass from row 68 to 66. This signal is supplied to the computer 50.

Figure 6:
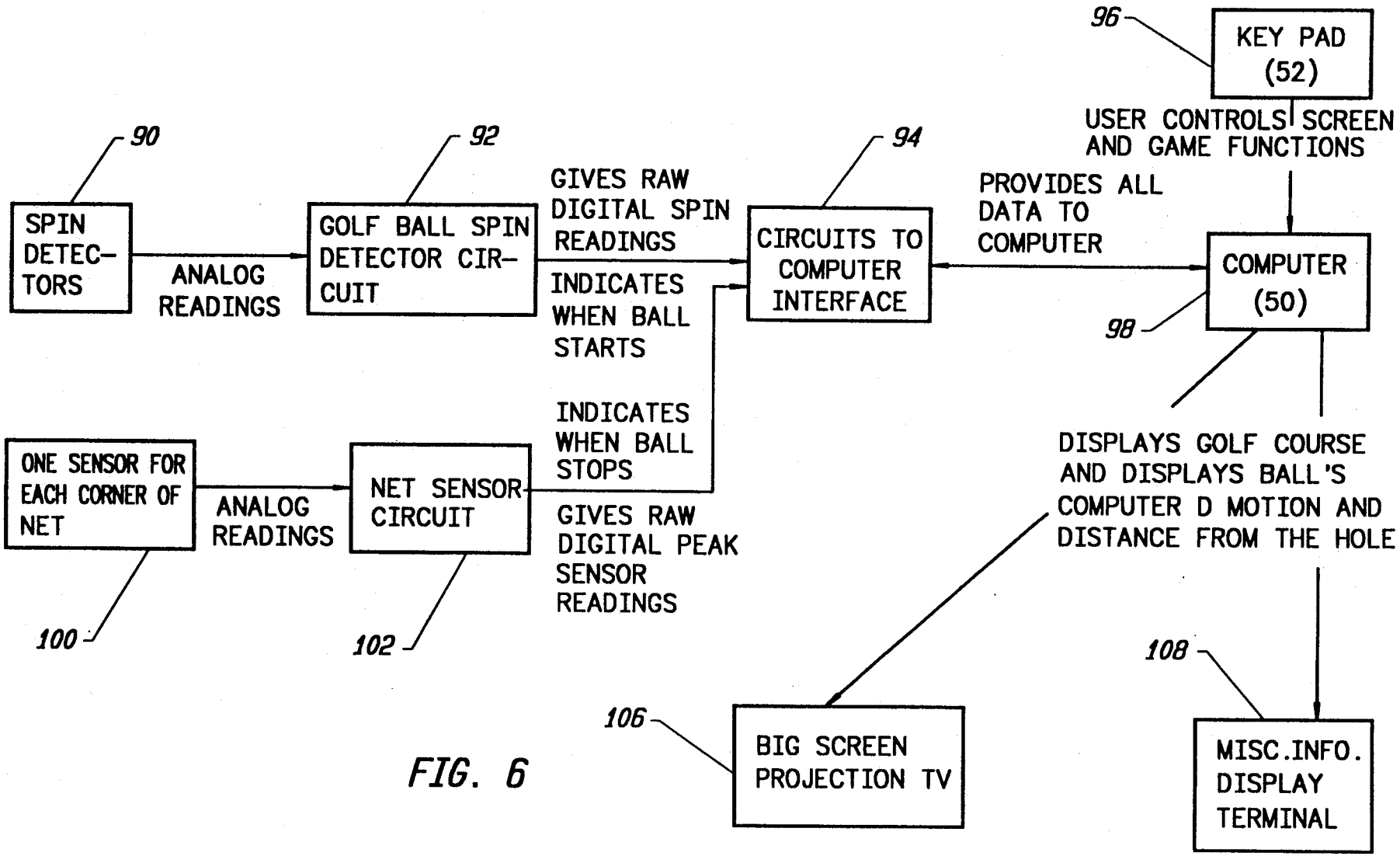
FIG. 6 is a functional block diagram of the preferred embodiment.

Referring to FIG. 6, an overall block diagram of the operation of the golf simulator 10 of the preferred embodiment is shown. Digital signals are produced by the spin detector 56A–B (90) and analog signals are produced by the net sensors 56A–D (100). At block 92 information from the golf ball spin detector sensors 56A–B provides raw digital spin readings. Also, this step indicates when the ball 46 intersects light paths from sources 54. In block 102, analog signal information from each of the four net sensors 56A–D is converted to provide raw digital sensor readings. Also, this block 102 indicates when and where the ball 46 reaches net 44. Both these signals from block 92 and block 102 are fed through a computer interface (at block 94) to computer 50 at block 98. A keypad 56 (represented by block 96) is provided for a golfer to access a computer to initiate a game of golf and to interact with computer 50 as the golf game proceeds. The keypad (96) permits the golfer to control those aspects of the screen and game functions which require user input. At step 98, the computer 50 processes and causes to be displayed the golf course as viewed from the vantage point of the golfer, the ball's projected motion as determined by computer 50, and the distance of the ball 46 from the simulated hole. This information may be displayed by the video projector 48 (106) or on additional display devices (108), such as a CRT (51 of FIG. 2). Computer 50 also automatically causes a printout to be made of a map of the green area 22 with the location of the ball so that a player can accurately place the ball in the green portion 22 and play out the hole. Once the data on ball spin, trajectory and speed is processed and determined by the computer 50, the trajectory and motion is then displayed. The view displayed on the screen 44 by the video projector 48 is updated to reflect the view from each new position of the ball to the green. The actual location of the ball, overlaid on a map of the hole, is displayed on the monitor 51. Alternatively, the flight path of the ball 46 could be displayed by the video projector 48 on the screen 44. The position of the ball 46 on the screen 44 is displayed in conjunction with sueh elements as "out of bounds," "hazards," "fairway," "rough," etc., which are taken into account in the display.

If a ball enters the imaginary rough, the computer 50 randomly assigns a condition to the ball 46 (based on a predetermined percentage). For example, the computer 50 may call lost balls 20% of the time, unplayable lies 20% of the time, out of bounds 30% of the time, and chip out so many yards to a given position 30% of the time.

Again, the present invention enables a player to use the computer/video module herein disclosed to play the longest part of the hole, reserving the green area for playing of balls considered to be within a predetermined distance from the hole, The exact location of the ball from the hole or green surround 22 is indicated. Groups of golfers are able to play together with a computer designed to keep track of each golfer's score and ball position, etc., simultaneously.

A printer and printout can also be integrated with the computer to give a printout of the hole and surround, with the position of each player's golf ball indicated thereon and can also be used to document each player's score.

Figure 7A:
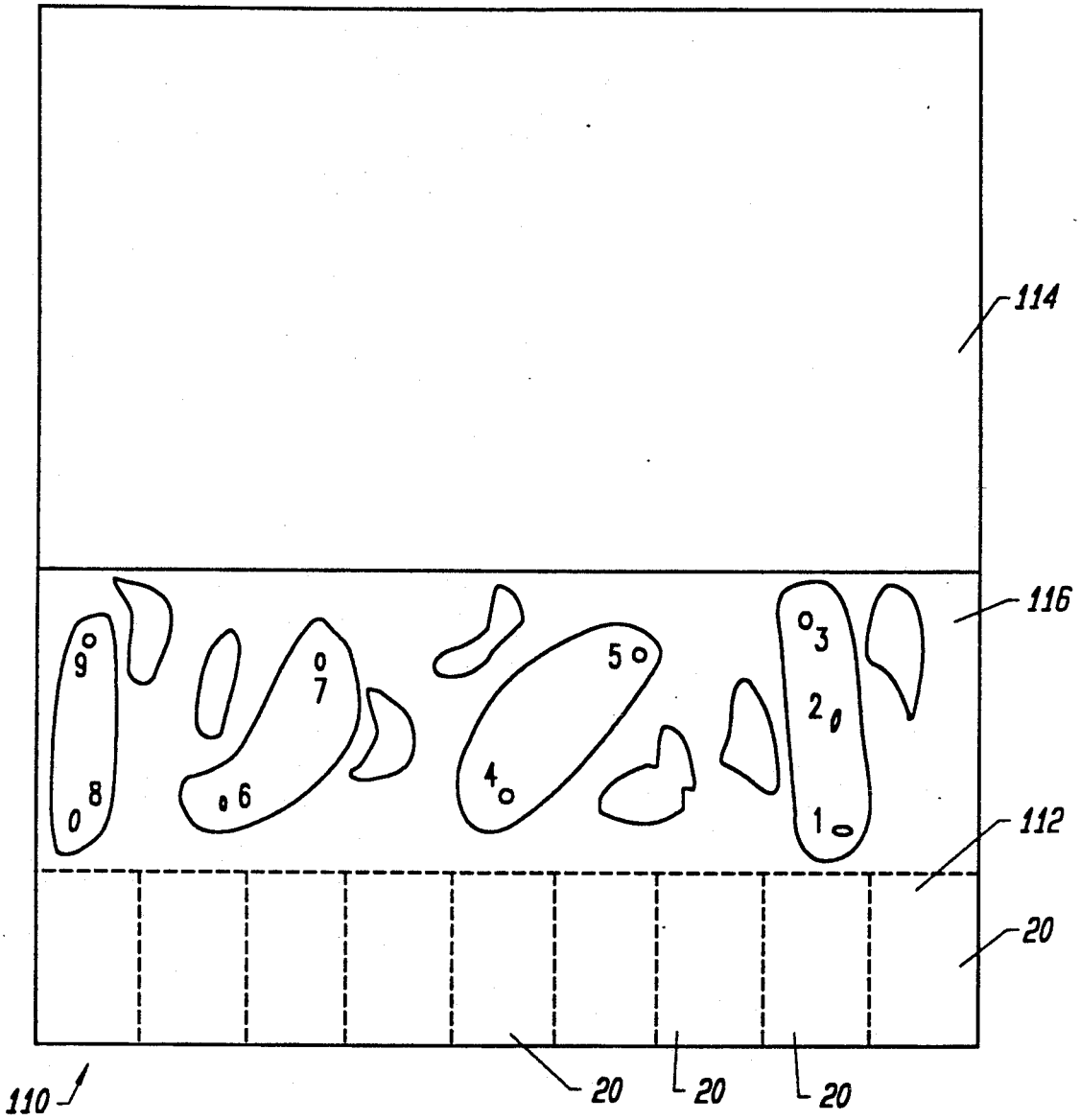
Figure 7B:
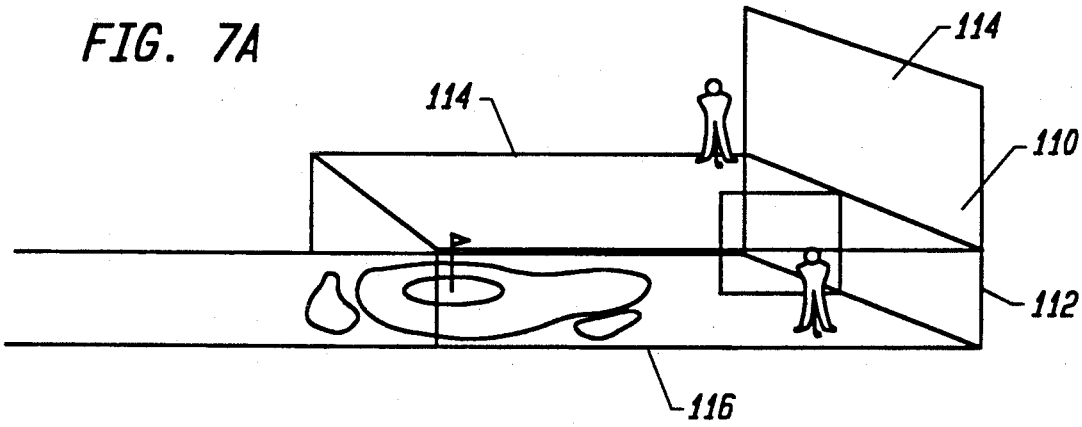

Referring to FIGS. 7*a* and 7*b*, a plan view and perspective view, respectively, of a plurality of golf simulators are shown in conjunction with a driving range 114. In this structure 110, a plurality of driving simulators 112 (numbered 1–9) are located adjacent a putting and/or chipping area 116. The putting/chipping area 116 contains several holes (numbered 1–9) which correspond to the driving simulators. Note that some holes may share a common green. Located above the simulator 112 and putting area 116 is a driving range 114. The driving range 114 serves as a weather shelter for the areas 112 and 116 and efficiently utilizes space.

Figure 8A:
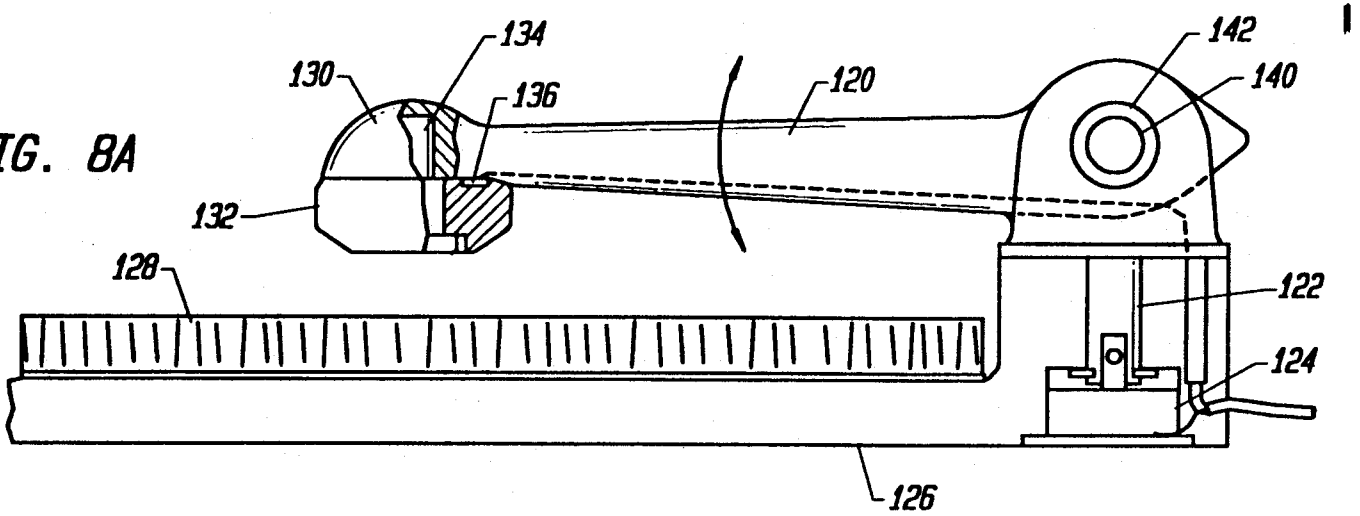
Figure 8B:
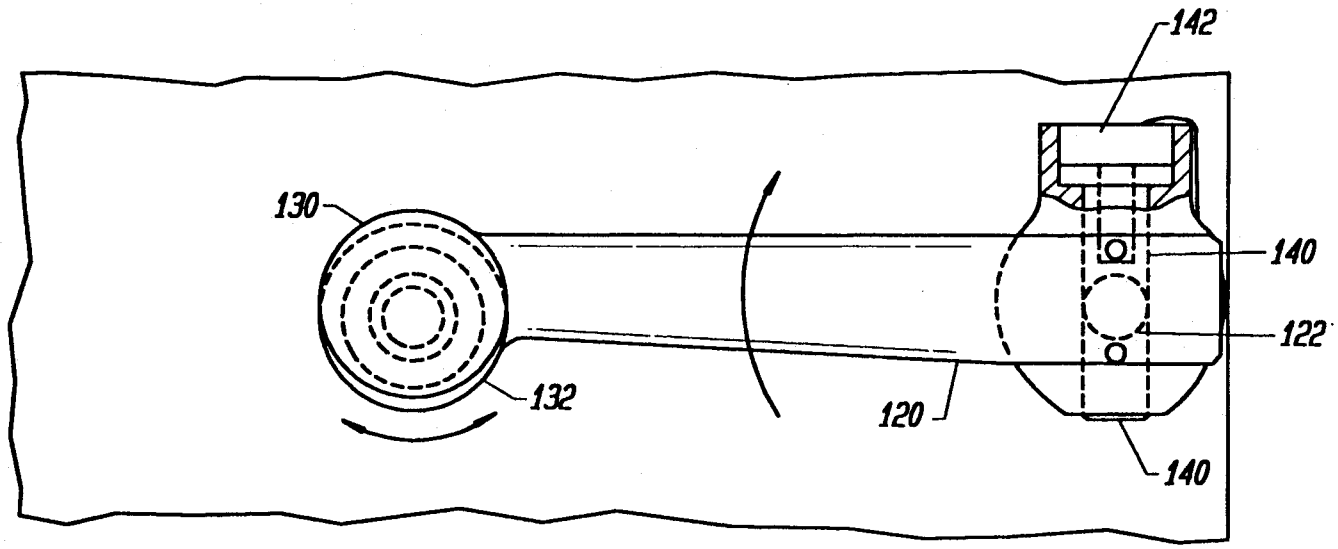

Referring to FIGS. 8*a* and 8*b*, a plan view and side view of another embodiment are presented. An arm 120 is positioned to rotate about a vertical shaft 122. A potentiometer 124 is coupled to shaft 122 to measure velocity. The potentiometer 124 is fixed to base 126. An artificial turf 128 is affixed to base 126 in such a manner that the turf 128 is under the arm 120.

A simulated golf ball 130 is attached to the end of arm 120 remote from pivot 122. A lower portion 132 of ball 130 is arranged to rotate around a shaft 134. The shaft inside the ball 130 in the ball portion other than the lower ball portion 132 is stationary. The lower portion 132 is free to spin about shaft 134 in the horizontal plane. The lower portion 132 of the ball 130 protrudes further out than the other portion. That way when a ball is hit it is guaranteed that the lower portion is hit first. Any horizontal spin induced by a golf club hit will cause the lower portion 132 to rotate in the horizontal plane. A potentiometer 136 measures the rate of rotation induced in the lower portion and feeds it back to a system computer for calculation of spin effect on trajectory.

Vertical lift of the golf ball 130 is determined by the measurement of rotation of arm 120 about pivot 140. The arm 120 rotates in the vertical plane about pivot 140. Potentiometer 142 measures the rise in the arm 120 which is absorbed after a period of rotation about pivot 122.

As shown in FIG. 9, another embodiment of the tee portion and spin detection portion of the invention has been shown. Thus, a resilient tee element 141 protrudes upwardly through a hole 143 in the mat of carpet, grass, or artificial turf grass. Element 141 remains anchored by a flange 141*a* beneath mat 144. The upper end of element 141 is shaped to support a golf ball-like element 146 characterized by a reflective surface portion 146*a* for purposes noted below.

A light source 147 directs a beam 148 of energy at the ball-like element 146 on tee element 141.

A ball movement sensor means 149 serves to provide information for computer analysis of the movement of the ball-like element 146. Sensor means 149 is disposed in the direction of movement of element 146 and oriented transversely thereof. Prior to striking ball-like element 146 (hereinafter "the ball"), the ball is oriented on the tee in a manner disposing the reflective surface 146*a* in position to direct light from beam 148 onto ball movement sensor means 149.

Sensor means 149, as best shown in FIG. 10, includes a pair of laterally spaced, vertically disposed lines 151, 152 of individual sensor elements carried on a semi-rigid support board 153. Board 153 also carries a pair of vertically spaced but horizontally disposed lines 154, 155 of sensor elements. Said movement sensor means 149 serves to detect horizontal and vertical spin of the ball-like element as explained below.

Thus, sensor board 153 provides information representative of the spin of ball 146 about each of two axes. It will be evident that, as ball 146 is struck, if it is rotated generally upwards about a horizontal axis, i.e. if the ball rotates clockwise as shown in FIG. 9, the reflected light on sensor board 153 will move generally upwardly to cross lines 154, 155. Thus, the time between flashing light on or off the spots in horizontal lines 154, 155 provides an indication of the amount of upward spin on the ball.

Similarly, the time between flashing light on or off the sensor elements in lines 151, 152 provides an indication of the amount of slice or hook, depending on whether the lights are being lighted moving from left to right or right to left.

Alternatively, if only two rows of sensor elements are employed, as for example lines 154, 155, the position at which the light spot crosses individual sensors of lines 154, 155 can also be used to detect the amount of "hook" or "slice" applied to the ball by the player.

Generally, spin can be detected by monitoring which individual detector switch on or off in a photodetector matrix.

As shown in the embodiment of the target portion of the driving unit, appearing in FIG. 11, an image of the golf hole being played is projected onto a flexible screen 156 so as to form something of a target. The target assembly 157 serves to detect the locus thereon where a ball driven into the target assembly strikes same. The target assembly comprises a matrix 158 of conductors generally comprising a first plurality of conductors disposed to extend in a first direction and a second plurality of conductors disposed to extend in a second direction and at a substantial angle to the first direction. Each of the first and second pluralities of conductors lies substantially in a plan associated with other conductors of such plurality to define first and second planes thereof. The first and second planes are closely spaced apart so as to be free from electrical contact therebetween except when struck by a driven ball. A preferred arrangement of the matrix noted above is shown in FIG. 11, wherein the first plurality of conductors can be considered to be those oriented vertically and the second plurality can be considered to be the conductors oriented horizontally and disposed behind those that are vertical.

A flexible sheet of material 156 hung in front of matrix 158 serves to provide a screen on which the golf hole can be displayed. A semi-rigid sheet of material 161 disposed behind matrix 158 whereby, as a driven ball 162 strikes the flexible sheet 156, ball 162 will move a conductor behind sheet 156 into engagement with a transversely extending conductor of the other plurality thereof to identify the locus of impact of the ball on the screen.

Accordingly, the horizontal and vertical position of the ball is identified by the intersection of a conductor from one plurality with a conductor from the other plurality.

Thus, as shown in FIG. 11, the output from the vertically oriented plurality of conductors is supplied via lead 163 to a switch array 164 of known design. Similarly, a lead 165 supplied the output from the horizontally oriented conductors of a second plurality to switch array 164. As thus arranged, switch array 164 has sufficient input information to identify the locus where the bass has struck the screen.

As noted above, the speed of the ball obviously serves to identify the distance which it is hit along the airway. In the present embodiment, this speed is readily detected by first noting when the reflective portion 146*a* indicates movement on sensor board 153, thereby indicating that the ball has been struck. This input information is supplied directly via lead 166 to computer 167. The input 168 from switch array 164 indicates that the target has been struck by the ball 162 and, therefore the time of flight of the ball from tee to target can readily be determined by computer 167.

Computer 167 subsequently generates an output on display 169 indicating the distance the ball has been hit based on the speed of the ball as detected, knowing the fixed distance between the tee and the screen.

According to another embodiment of the invention as explained with respect to the diagrams shown in FIGS. 12 and 13 using the apparatus previously described employing the computer 50 or 167 for controlling the video projector 48, applicant has shown in FIG. 13 a projected image of a selected hole from a given golf course as desired and selected by the player.

Since it will be evident that adjacent the driving simulator a putting green will be provided, it will not be practical to interchange putting greens with each selected hole as shown in FIG. 12.

After each player of a foursome has played to within a predetermined range of hole 172, their positions on the screen 40 are identified with respect to the selected hole being played, as A, B, C and D. Computer 50 calculates where each of these positions would be located with respect to the outdoor putting green area in order to provide a substantially "equivalent" shot to the cup as shown on the selected golf hole.

For example, an equivalent shot to the cup from position A (FIG. 12) is shown at No. 1 on a plan view of the real putting green in FIG. 13.

Thus, as shown in FIG. 12, the shot from point A to the cup is a long chip across grass with no intervening hazards. Computer 50 determines a similar location to be projected onto the screen 40 and identified with No. 1.

Computer 50 identifies the type of chip or pitch shot each player A–D has and determines a substantially equivalent shot associated with the outdoor putting green. The locations are identified by numbers 1, 2, 3 and 4, respectively, on an overhead or plan view of the outside adjacent green region which is then projected onto screen 40 together with the numbers 1, 2, 3 and 4. Then the players are instructed to proceed to the real green and place their ball at the numbered positions projected. This instruction can be as simple as projecting onto screen 40 the numeric location of all balls being played.

Thus, while a duplicate of the selected green may not be available, the shots required to be made around the selected green can be reproduced in the above manner.

Thus, as shown in FIG. 13 a plan view of the putting green described above has been employed together with a suitable computer program for determining and displaying the location of the player's ball when the ball lies within a predetermined distance from the projected hole.

Accordingly, in FIG. 12 the projected hole has been provided with an imaginary phantom line 171 representative of the predetermined distance from the hole 172. Assuming as shown in FIG. 12 that four shots have been played identified by the letters A, B, C and D. The shot by player A will be a straight pitch toward the hole with the lesser portion of the show being between the edge of the green and hole 172. Accordingly, as shown in FIG. 13 the position identified as number 1 carries a cross where a ball could be located to be pitched toward the hole 174 with the lesser part of the distance of the shot being on the green 177.

Similarly, the shot shown in FIG. 12 by player B is across a short stretch of grass and onto the green and accordingly computer 50 (or 167) can readily locate the B player's ball at a position identified by the cross associated with numeral 2 in FIG. 13. Player C's ball is located in a trap 179 behind the green 178. In order to get out of the trap, player C must pitch his ball over a short amount of sand and a narrow band of grass onto the green where the major portion of the travel of the ball is provided. As shown in FIG. 13 numeral 3 represents a substantially equivalent shot to the putting green as described above for C.

Finally as shown in FIG. 12, player D must shoot a relatively long pitch to hole 172. A comparable shot is provided from the position identified by the numeral 4 in FIG. 13.

Thus, computer 167 or 50 according to the present embodiment controls video projector 48 in the foregoing manner. In this way the player can play a number of different courses and while the greens which he will play upon will not actually be identical. There will be a substantial similarity between the shots which he is required to make and those which he would be required to make if he were playing the real course.

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. An apparatus comprising:

a golf ball including only one reflective portion on its exterior surface;

a single light source for impinging light upon said reflective portion of said golf ball; and photo detector array means for measuring change in the reflection of light from said reflective portion of said golf ball to detect spin applied to said golf ball when said golf ball is struck.

2. The apparatus of claim 1 wherein said photo detector array means comprises:

a first row of light responsive devices;

a second row of light responsive devices; and means for identifying the time elapsed between the reflection of flight from said first row to said second row, said elapsed time corresponding to said spin applied to said golf ball when said golf ball is struck.

3. A golf apparatus comprising:

(A) a simulator including:

(1) means for projecting a plurality of images corresponding to a plurality of golf holes to be played, each of said plurality of golf holes including a fairway, a bunker and a green;

(2) means for generating signals indicative of the flight of a golf ball which is hit by a player, said generating means including:

(a) a golf ball including only one reflective portion on its exterior surface, (b) a single light source for impinging light upon said reflective portion of said golf ball, (c) means for measuring change in the reflection of light from said reflective portion of said golf ball to detect spin applied to said golf ball when said golf ball is struck, said measuring means generating a spin signal;

(d) a first conductor matrix including a plurality of conductors extending in a first direction, (e) a second conductor matrix closely positioned behind said first conductor matrix, said second conductor matrix including a plurality of conductors extending in a second direction which is at a substantial angle to said first direction, and (f) a switch array alternately coupled to said first conductor matrix and to said second conductor matrix, said switch array receiving a first conductor signal when a driven golf ball impinges said first conductor matrix, said switch array receiving a second conductor signal when said driven golf ball forces said first conductor matrix against said second conductor matrix;

(3) means for correlating said spin signal, said first conductor signal, and said second conductor signal with one of said images of one of said golf holes to a golf ball position on one of said golf holes, said projecting means thereafter providing an image of said golf ball position on one of said golf holes; and (B) a multiple-hole chipping/putting area including (1) a chipping area with a plurality of bunkers, and (2) a putting green with a plurality of putting cups forming a green region, said plurality of bunkers and said plurality of putting cups corresponding to said plurality of golf holes, said plurality of bunkers and said plurality of putting cups forming a spatial region which is divisible into four 90° regions, said plurality of bunkers and said plurality of putting cups of said green region enabling approaches to each of said plurality of golf holes from more than one of said 90° regions.

* * * * *